US008720080B2

(12) United States Patent
Jayne et al.

(10) Patent No.: US 8,720,080 B2
(45) Date of Patent: May 13, 2014

(54) METHOD AND APPARATUS FOR DRYING ROOMS WITHIN A BUILDING

(75) Inventors: Jonathan Robert Jayne, Llantrisant (GB); Mark Lee Robinson, Llantrisant (GB); Philip Harris, Llantrisant (GB); Daniel Court, Llantrisant (GB); Andrew Charles Habbershaw, Romford (GB)

(73) Assignee: DBK Technitherm Limited, Llantrisant (GB)

( * ) Notice: Subject to any disclaimer, the term of this patent is extended or adjusted under 35 U.S.C. 154(b) by 496 days.

(21) Appl. No.: 12/491,511

(22) Filed: Jun. 25, 2009

(65) Prior Publication Data

US 2010/0011612 A1 Jan. 21, 2010

Related U.S. Application Data

(60) Provisional application No. 61/194,062, filed on Sep. 23, 2008.

(30) Foreign Application Priority Data

Jul. 18, 2008 (GB) ..... 0813169.0

(51) Int. Cl.

| | |
|---|---|
| ***F26B 19/00*** | (2006.01) |
| ***F26B 21/08*** | (2006.01) |
| ***F26B 5/04*** | (2006.01) |
| ***F26B 3/00*** | (2006.01) |
| ***F26B 7/00*** | (2006.01) |
| ***F26B 21/00*** | (2006.01) |
| ***F26B 3/02*** | (2006.01) |

(52) U.S. Cl.

CPC ..... *F26B 3/02* (2013.01)
USPC ..... 34/352; 34/557; 34/417; 34/358; 34/378; 34/477; 34/566

(58) Field of Classification Search

CPC ..... F26B 3/02; F26B 3/04; F26B 3/19; F26B 9/00; F26B 19/00
USPC ..... 34/218, 557, 417, 443, 445, 446, 474, 34/477, 486, 352, 376, 378, 492, 358, 330, 34/566

See application file for complete search history.

(56) References Cited

U.S. PATENT DOCUMENTS

| | | | | |
|---|---|---|---|---|
| 6,161,763 | A * | 12/2000 | Reuter | 236/44 C |
| 6,327,812 | B1 | 12/2001 | Hedman et al. | |
| 6,457,258 | B1 * | 10/2002 | Cressy et al. | 34/443 |
| 6,662,467 | B2 | 12/2003 | Cressy et al. | |

(Continued)

FOREIGN PATENT DOCUMENTS

| | | | | |
|---|---|---|---|---|
| EP | 0505116 | A2 * | 9/1992 | A47K 10/48 |
| GB | 2289752 | A | 11/1995 | |

(Continued)

*Primary Examiner* — Kenneth Rinehart
*Assistant Examiner* — John McCormack
(74) *Attorney, Agent, or Firm* — Simpson & Simpson, PLLC

(57) ABSTRACT

A method and apparatus for drying a room within a building by sealing the room from outside ambient air ingress, heating the room internally, sensing humidity levels within the room, exhausting the air from within the room and drawing in outside ambient air, sensing water content within the room, and repeating the sequence until a dry status indication is received that the water content within the room has been reduced a predetermined level.

16 Claims, 4 Drawing Sheets

(56) References Cited

U.S. PATENT DOCUMENTS

| | | | | |
|---|---|---|---|---|
| 6,892,491 | B2 | 5/2005 | Hedman | |
| 7,403,126 | B2 * | 7/2008 | Pedraza et al. | 340/604 |
| 7,837,932 | B2 | 11/2010 | Hedman | |
| 8,006,407 | B2 * | 8/2011 | Anderson | 34/381 |
| 2001/0004813 | A1 | 6/2001 | Hedman | |
| 2002/0066223 | A1 | 6/2002 | Hedman et al. | |
| 2004/0028554 | A1 | 2/2004 | Hedman | |
| 2004/0028583 | A1 | 2/2004 | Hedman | |
| 2005/0013727 | A1 | 1/2005 | Hedman | |
| 2005/0220662 | A1 | 10/2005 | Hedman | |

FOREIGN PATENT DOCUMENTS

| | | | |
|---|---|---|---|
| GB | 2375812 | A | 11/2002 |
| WO | WO 9621834 | A1 * | 7/1996 |
| WO | WO 2004/011865 | | 5/2004 |

* cited by examiner

METHOD AND APPARATUS FOR DRYING ROOMS WITHIN A BUILDING

CROSS-REFERENCE TO RELATED APPLICATIONS

This application claims the benefit of U.S. Provisional Application No. 61/194,062 filed Sep. 23, 2008. This application also claims the benefit of British Application No. GB0813169.0, filed Jul. 18, 2008.

BACKGROUND

This invention relates generally to the field of water damage restoration and water removal. More specifically, the invention relates to methods and apparatuses for drying damp or water damaged buildings.

SUMMARY OF THE INVENTION

According one embodiment of the invention there is provided a method of drying damp or waterlogged rooms within a building including the steps of sealing the room from outside ambient air ingress and heating it internally until the inside ambient air there within is warm and humid following surface evaporation of water in the room, thereafter exhausting the warm and humid air from the room and drawing in outside ambient air, and monitoring temperature and humidity levels within the room, the sequence continuing until an indication is received that the room is suitably dry.

In one embodiment, the sealing step involves substantially sealing the room by closing windows and doors, etc. In such an embodiment nominal air leakage is permissible. In other embodiments additional measures may be taken to more completely seal the room.

In one embodiment the dry status of the room being dried is communicated via a signal, such as by telecommunications, to a monitor operator who may therefore abort or otherwise cancel the drying process at the earliest convenient time, therefore saving energy that would otherwise be used for drying an otherwise suitably dry room.

In accordance with other embodiments of the invention there is provided a drying apparatus for installation within a sealed damp or waterlogged room. In one embodiment there is included a sensing means to sense the level of humidity and water content within the room. Such sensing means may include any device known in the art or arising hereafter for sensing humidity or water content, including, by way of example only, capacitive humidity sensors, resistive humidity sensors, and thermal conductivity sensors, in addition to other means that may be described herein. The apparatus of the embodiment may further include sensing means to sense the temperature level of air or surfaces within the room. Such sensing means may include any device known in the art or arising hereafter for sensing temperature, including, by way of example only, contact and non-contact temperature sensors, in addition to other means that may be described herein.

In one embodiment the apparatus further includes a heating means to provide heat for the room. Those of ordinary skill in the art will readily understand that a variety of conventional and after arising heating means could be employed, including, by way of example only, heating via passing electric current through a heating element, in addition to other means that may be described herein.

In one embodiment the apparatus further includes an air circulation means for selectively circulating heated air within the room, exhausting warm and humid air from the room, and for drawing outside ambient air into the room. A variety of combinations of conventional and after arising components for air circulation means could be employed, including, by way of example only, the use of fans enclosed in ducts, and the use of a gate valve, or multiple gate valves, to control and direct air flow, and as set out in greater detail in the drawings and other descriptions provided herein.

In one embodiment the apparatus further includes sensor means for measuring selected characteristics indicative of water content within the room and means for cyclically changing the air within the room when a predetermined level of air humidity is reached. Such sensing means may include any device known in the art or arising hereafter for sensing humidity or water content, including, by way of example only, capacitive humidity sensors, resistive humidity sensors, and thermal conductivity sensors, in addition to other means that may be described herein.

In one embodiment the apparatus is adapted to cyclically continue until the sensed humidity reaches a required level, the apparatus thereafter indicating, directly or indirectly, the completion of the drying process.

In one embodiment a heater, such as an electric heater, is coupled via ducts to air circulation fans, such as an inlet fan and an outlet fan, the inlet fan selectively either circulating air within the room until a chosen saturation point is sensed or, via the use of an air intake valve, drawing outside ambient air into the room to replace saturated air expelled by the exhaust fan at the end of each drying cycle.

In one embodiment a central processing unit receives sensed signals from sensors in the room and on or in the apparatus which sense air or surface humidity. This may conveniently be achieved by temperature and humidity sensors positioned at the intake end of the intake fan and by corresponding sensors upstream of the exhaust fan, which may be further enhanced by sensors embedded in or on the walls of the room in various chosen locations, such as the floor, walls and roof, to detect humidity levels or electrical conductivity indicative of humidity levels.

In one embodiment the apparatus also includes means for recording energy used during the drying process, so as to maximize the energy efficiency, and a timer for recording data at required intervals, such as hourly. A variety of combinations of conventional and after arising components for recording means could be employed, including, by way of example only, the use of a memory card reader device capable of reading and writing to a memory card, such as a flash card, flash drive, or smart card, via any convenient interface known in the art or arising hereafter, such as, by way of example, a USB, serial port, or parallel port interface, or via wireless USB, Bluetooth or other wireless interface technologies.

Although the apparatus may be stand alone and simply operate until it detects that the room within which it is installed is sufficiently dry, it may instead include a remote communications facility which indicates to a monitor of the apparatus, such as an electronic control unit, that the room is sufficiently dry for the apparatus to be removed and relocated if necessary to dry another room.

BRIEF DESCRIPTION OF THE DRAWINGS

Several embodiments of the invention will now be described, by way of example only, with reference to the accompanying drawings in which.

DETAILED DESCRIPTION OF THE DRAWINGS

Figure 1:
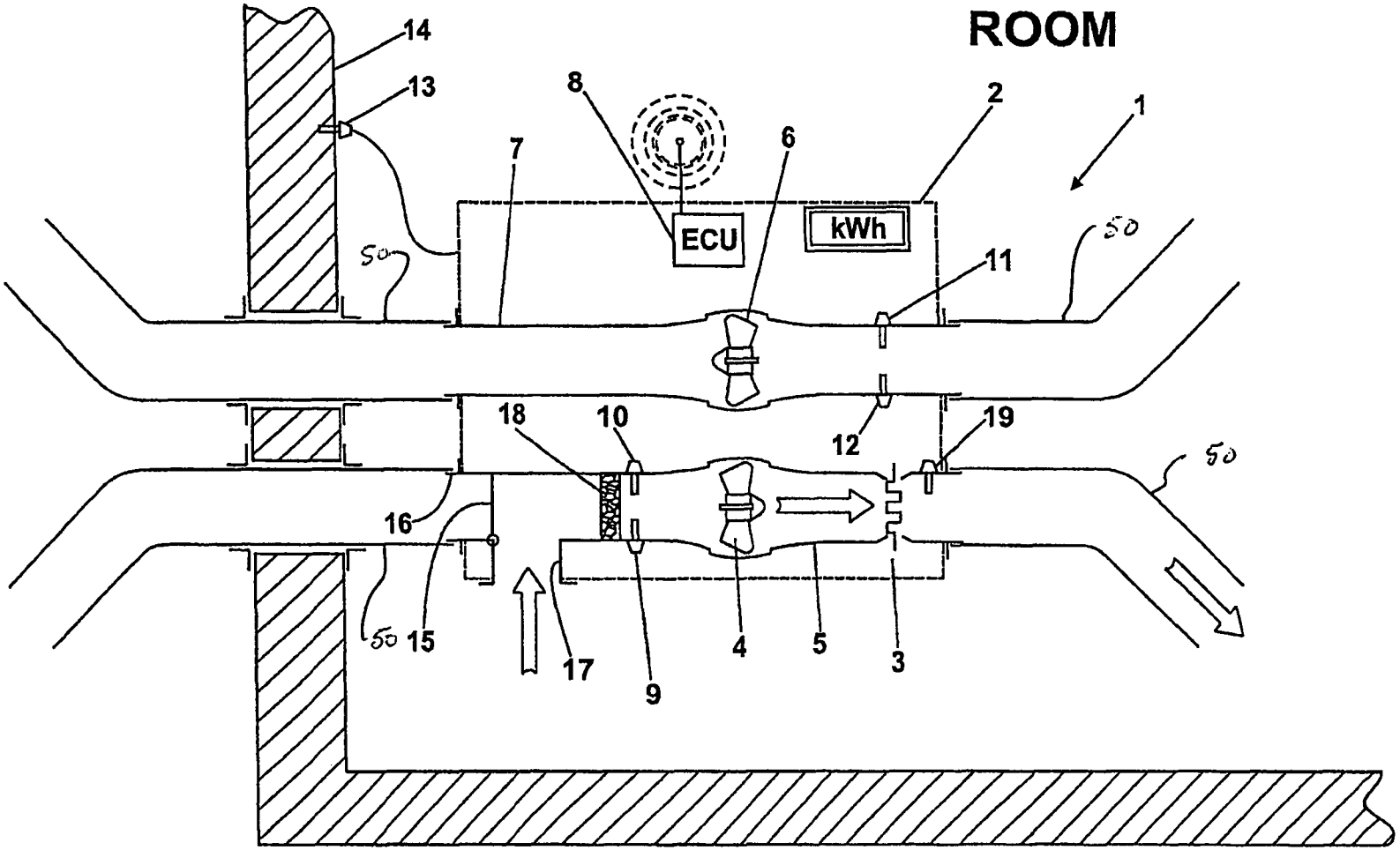
FIG. 1 is a schematic drawing of a drying apparatus operating in air circulation mode.

Turning now to FIG. 1 there is shown a schematic view of part of a damp or waterlogged room to be dried in accordance with the method of the invention in which drying apparatus shown generally at 1 includes a heater housing 2 containing a heater element 3 and inlet fan 4 housed within an inlet duct 5 as well as outlet fan 6 and outlet duct 7, collectively by which heated air may be circulated within the room and exhausted from it when required.

The apparatus 1 also includes an electronic control unit (ECU) 8 which monitors sensed signals from a temperature sensor 9 and a humidity sensor 10 upstream of the air intake fan 4 as well as exhaust temperature sensor 11 and exhaust humidity sensor 12 upstream of the exhaust fan 6. In addition, the ECU 8 also monitors via a wall-mounted humidity or conductivity sensor 13 the amount of water in the wall 14 of the room being dried. Control and variation of the air circulation within and without the room is by means of a simple gate valve 15 positioned between an outside ambient air inlet duct 16 and a room air inlet 17, with an air filter 18 being positioned within the air inlet duct 5 immediately downstream thereof.

A further temperature sensor 19 is provided immediately downstream of the heater element 3 to indicate a blocked filter 18 or loss of air flow due to e.g. failure of the inlet fan 4.

In operation in accordance with the mode shown in FIG. 1 it will be apparent that heated air within the room is simply being re-circulated, and in accordance with the method of the invention, this continues until the ECU 8 senses that the required water saturation point has been reached, via sensed signals received from the various sensors 9,10,11,12, and 13. At this point, the apparatus 1 is switched by ECU 8 to the mode illustrated in FIG. 2 in which it will be seen that the gate valve 15 has been rotated through 90 degrees via a command from the ECU 8 such that it only allows outside ambient air into the room via the ambient air inlet 16, which then passes through the filter 18 and is monitored by the temperature and humidity sensors 9,10 and then heated via the heater element 3 to thereafter be monitored for temperature and humidity by sensors 11 and 12.

In this exhaust mode the apparatus 1 is effectively removing warm humid air from the room and replacing it with dryer outside air, but which is preheated as it enters the room, thereby minimizing the possible effects of condensation caused by cold outside air entering the heated room.

The ECU 8 may conveniently include a radio transmitter or other remote control sensing and control functions, for example for providing a warning that the room is dry following successive cycles of air recirculation and air exhaust. In this way, maximum use is made of the property of the air within the room to absorb water until it reaches a required water saturation point whereafter all the air in the room is then exhausted to be replaced by fresh, outside ambient but warmed air of a relatively low humidity which can thereafter more readily absorb evaporated water in the room at the least cost in terms of energy.

In order to provide fluid communication between the unit 1 and the room and between the unit and the outside ambient air, optional flexible tubing 50 is employed.

Figure 2:
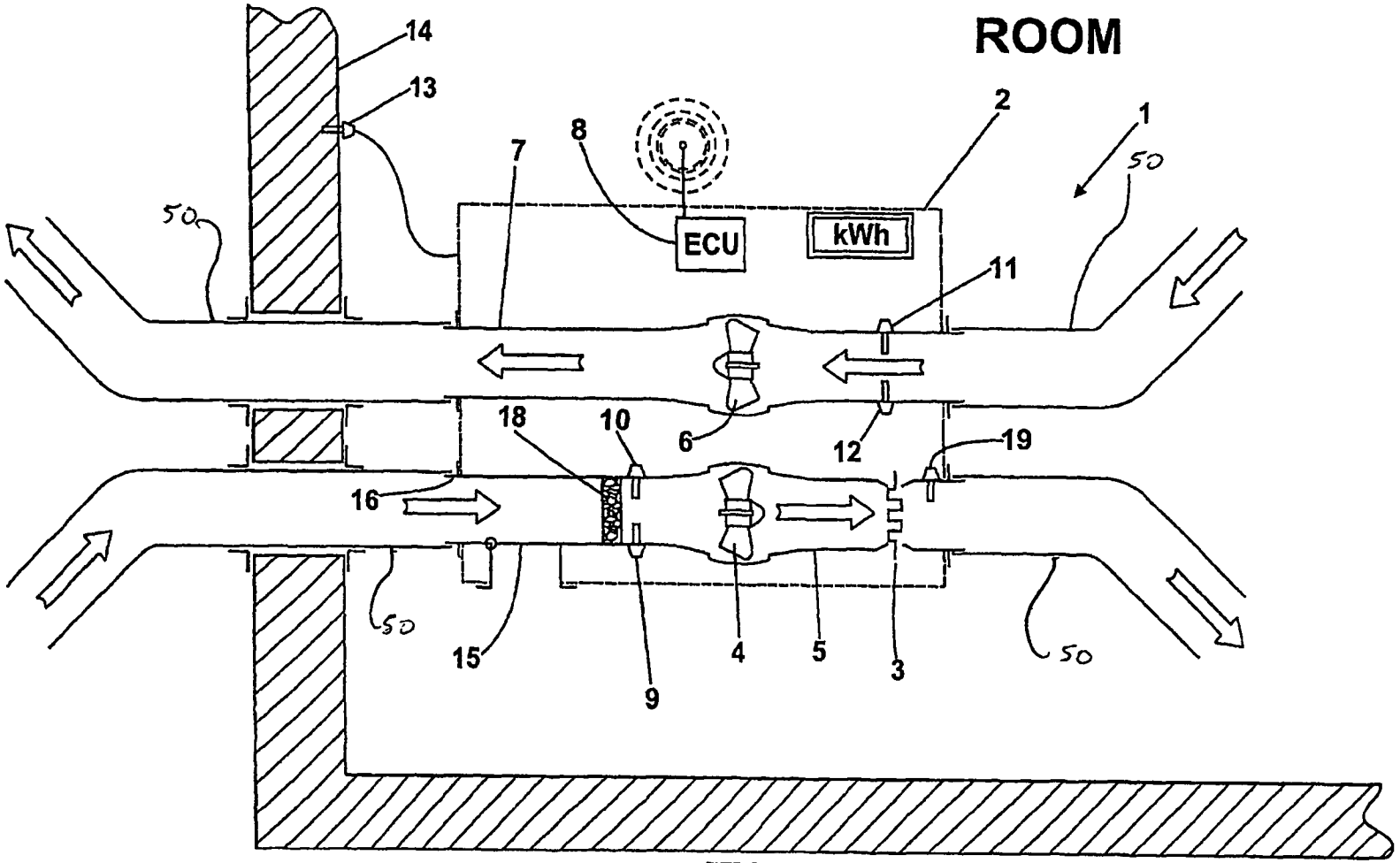
FIG. 2 is a schematic view of a drying apparatus operating in an air exchange/removal mode.
Figure 3:
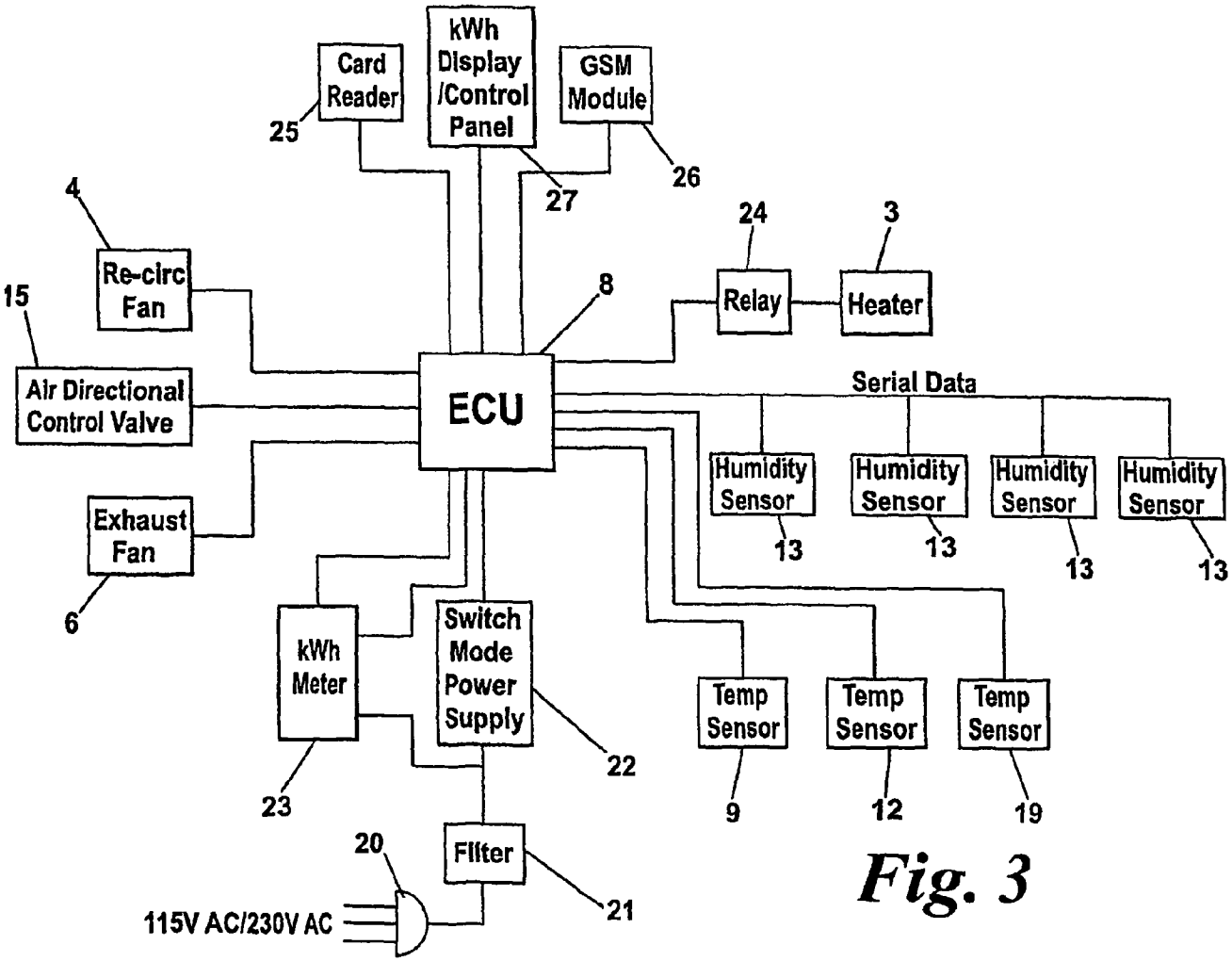
FIG. 3 is a schematic circuit diagram of a drying apparatus.
Figure 6:
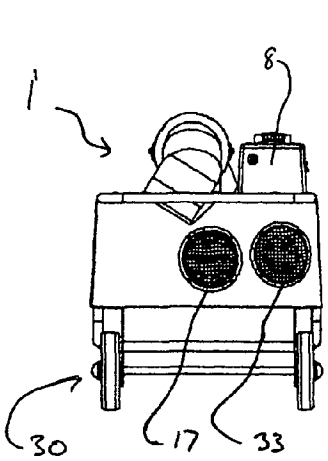
FIG. 6 is a rear view of a drying apparatus.
Figure 5:
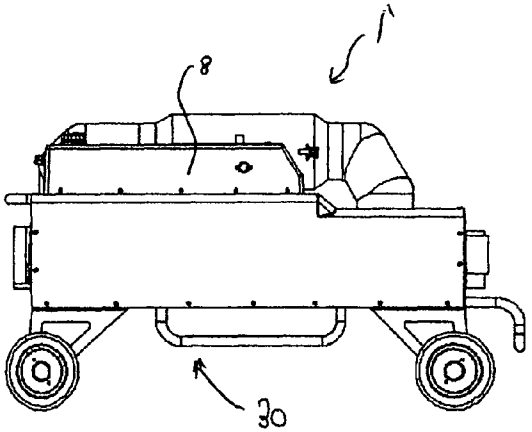
FIG. 5 is a side view of a drying apparatus.
Figure 4:
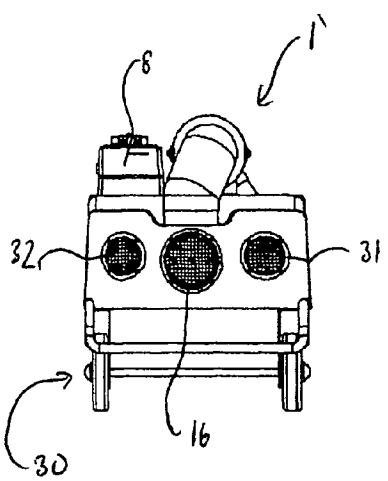
FIG. 4 is a front view of a drying apparatus.

Turning now to FIG. 3 there is shown a simplified circuit diagram for the apparatus described in FIGS. 1 and 2 where like numbers are given to like parts. As is shown, most of the various components are connected to the ECU 8, which therefore controls the method and apparatus described earlier. As well as various temperature and humidity sensors 9,10,11,12 and 19 being arranged within the apparatus 1 there are also humidity sensors 13 which may conveniently be positioned on floor, wall and ceiling surfaces of the room within which the apparatus 1 is installed.

The apparatus 1 may conveniently be provided with a mains electricity supply 20 which passes through a regulating filter 21 to reduce RF emissions and the electrical power is then supplied via a switch mode power supply unit 22 and measured by a meter 23. With the main electrical drain being via the heater 3 a control relay 24 is incorporated within the apparatus 1 upstream of the heater 3 to provide a mechanical cut-out in the circuit to prevent over temperature in the event of reduced airflow.

The ECU 8 may conveniently include or have communications access to a card reader 25 to store logged data from the drying process, such as temperature, humidity, energy used, and any error signals. This may be uploaded to a PC via a smart card for subsequently inspecting the data stored during the drying cycle. Alternatively, remote communication may be via a GSM module 26 to thereby remotely indicate when a room within which the apparatus 1 has been installed has been dried. A power consumption and control panel 27, which may be incorporated within the apparatus or remote therefrom, monitors and displays the status of the drying operation and the apparatus 1, and may also be used to modify the mode of operation by, for example, extending the drying cycle for a period beyond the indicated or projected time to dry a given room.

Referring to FIGS. 4, 5, 6, and 7, respectively, front end, side, rear end, and plan views are shown of a an alternative embodiment of a drying apparatus 1'. The alternative embodiment operates as described above and is similar in construction to the embodiments shown in FIGS. 1 and 2, where like parts have like reference numerals.

The alternative apparatus 1' is mounted on a wheeled cart 30 so that it can be wheeled to a suitable location in a room to be dried. The circuitry and mechanical parts described above may be replicated in this alternative apparatus 1', but are hidden from view within the casing of the embodiments of the apparatus depicted in FIGS. 4,5,6, and 7.

In use, the room 14 may be sealed and in a first operating mode, room air may be drawn into internal inlet duct 17, heated within apparatus 1' and expelled back into the room via room outlet duct 31. The warmed air may be monitored for humidity level and recirculated, continually increasing in temperature and humidity. When a user defined, or pre-set humidity level is reached the apparatus may be switched to a second mode whereby the moisture laden air in the room is sucked into further inlet duct 33 and exhausted from the room via exhaust duct 32. At the same time, fresh air may be drawn into external inlet duct 16 from outside the room. That fresh air may then be heated and forced into the room via room outlet duct 31.

Figure 7:
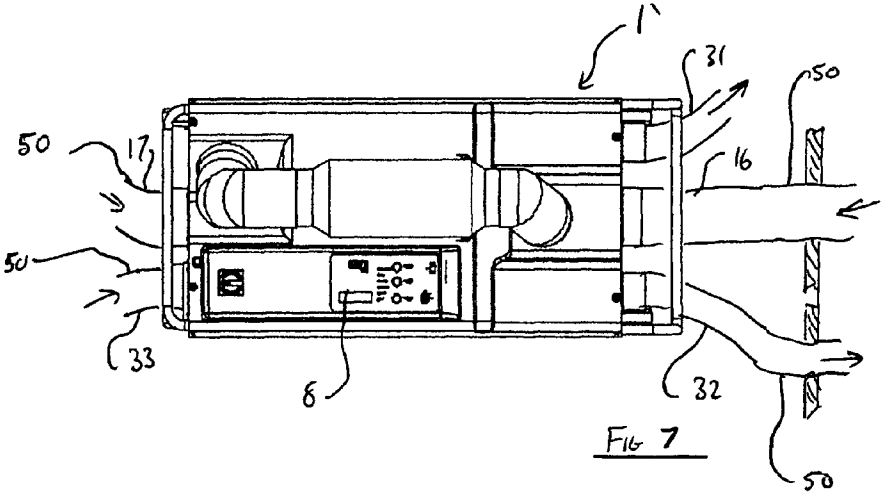
FIG. 7 is a plan view of a drying apparatus.

FIG. 7 shows the apparatus connected to flexible tubing 50. This tubing is used to connect the apparatus to external sources of air and to direct the ducts 17,31 and 33 to suitable locations in the room. For example the heated air outlet duct 31 can be directed to a locally damp area in the room to aid drying in that area.

To aid accuracy, humidity within the room can be monitored at more than point for example via remote humidity sensors as described above. These monitors can transmit humidity data between them, so only one needs to be in line of sight with the apparatus if IR communication is used. Various safety features can be employed, for example a maximum room temperature can be selected or pre-set. If reached, perhaps when the room is dry and not increasing in humidity beyond a selected or pre-set level, then the apparatus operates in the second mode of operation, thereby drawing in fresh air to the room and lowering the room temperature.

Whilst several embodiments of the invention have been described in fairly simplistic terms it will be understood that many variations are possible which allow for particular drying cycles to be adopted depending upon prevailing conditions without departing from the spirit or scope of the invention.

What we claim is:

1. An apparatus for drying a room, the apparatus comprising:

a first duct comprising a first end arranged to receive ambient air from outside the room, a second end arranged to output air into the room, a valve positioned between the first and second ends, and an inlet air circulation fan positioned between the valve and the second end;

a second duct comprising a first end arranged to expel air from the room, a second end arranged to draw in air from the room and an outlet air circulation fan positioned between the first and second ends;

a heater arranged to heat the air within the room; and, a first humidity sensor arranged to detect a level of humidity in the room, wherein the apparatus is configured to operate in either a re-circulating mode or an exhausting mode, wherein when the level of humidity within the room is less than a predetermined level of air humidity the apparatus is operated in the re-circulating mode whereby the valve is positioned to block entry of air from outside the room while permitting entry of air from within the room into the first duct, the inlet air circulation fan is circulating air and the outlet air circulation fan is not circulating air, wherein when the predetermined level of air humidity is reached the apparatus is operated in the exhausting mode whereby the valve is positioned to permit entry of air from outside the room while blocking entry of air from within the room into the first duct, the inlet air circulation fan is circulating air and the outlet air circulation fan is circulating air.

2. The apparatus of claim 1 wherein the heater is positioned in the first duct between the inlet air circulation fan and the second end.

3. The apparatus of claim 1 wherein the first humidity sensor is positioned within the first duct between the valve and the inlet air circulation fan.

4. The apparatus of claim 1 further comprising a second humidity sensor positioned within the second duct.

5. The apparatus of claim 1 wherein the apparatus operates in the re-circulating mode prior to a set period of time having elapsed.

6. An apparatus for drying a room within a building, the apparatus comprising:

sensing means to sense a level of humidity within the room;

heating means positioned within the room for heating the room internally;

air circulation means for selectively circulating heated air within the room in a recirculating mode and exhausting warm and humid air from the room and for drawing outside ambient air into the room in an exhausting mode;

said air circulation means comprises first and second ducts, said first duct comprising a first end arranged to receive outside ambient air, a second end arranged to output air into the room, a valve positioned between the first and second ends and an inlet air circulation fan positioned between the valve and the second end, said second duct comprising a first end arranged to expel air from the room, a second end arranged to draw in air from the room and an outlet air circulation fan positioned between the first and second ends;

sensing means for measuring selected characteristics indicative of water content within the room;

means for cyclically changing air within the room wherein when a predetermined level of air humidity is reached the air circulation means operates in the exhausting mode, whereby the means for cyclically changing the air activates the inlet air circulation fan, activates the outlet air circulation fan and opens the inlet valve permitting air to pass from the first end to the second end of the first duct when the predetermined level of air humidity is reached, and further wherein when the level of humidity within the room is less than the predetermined level of air humidity, the air circulation means operates in the recirculating mode whereby the means for cyclically changing the air continues to activate the inlet air circulation fan, deactivates the outlet air circulation fan and closes the valve preventing air from passing through the first end of the first duct to instead be recirculated via the room air inlet duct;

the apparatus being adapted to cyclically continue until the sensed humidity reaches the predetermined level; and means for directly or indirectly providing a drying indication.

7. Apparatus according to claim 6 wherein the apparatus includes a heater, coupled via the first and second ducts to the inlet and outlet air circulation fans selectively: re-circulating air within the room via the use of the first duct until a chosen saturation point is sensed, re-circulating air within the room via the use of the first duct until a set period has elapsed or, drawing outside ambient air into the room via the use of the first duct to replace saturated air expelled by the second duct at the end of each drying cycle.

8. Apparatus according to claim 6 wherein the heating means is an electric heater.

9. Apparatus according to claim 6 which includes a heater coupled via ducts to air circulation fans wherein the air circulation fans comprise at least an inlet fan and an outlet fan.

10. Apparatus according to claim 6 wherein a central processing unit receives sensed signals from sensors in the room and on or in the apparatus which sense air or surface humidity.

11. Apparatus according to claim 6 wherein temperature and humidity sensors are positioned upstream of the heating means and upstream the means for selectively exhausting warm and humid air from the room.

12. Apparatus according to claim 6 wherein sensors connected or connectable thereto are embedded in or on the walls of the room in various chosen locations, such as the floor, walls and roof, to detect humidity levels or electrical conductivity indicative of humidity levels.

13. Apparatus according to claim 6 wherein means are provided for recording energy used during the drying process so as to maximize energy efficiency, and a timer for recording data at required intervals, such as hourly.

14. Apparatus according to claim 6 wherein the apparatus is stand alone and operates until it detects that the room within which it is installed is sufficiently dry.

15. Apparatus according the claim 6 wherein the apparatus includes a remote communications facility which indicates to a monitor of the apparatus that the room is sufficiently dry for the apparatus to be removed and relocated if necessary to dry another room.

16. Apparatus according to claim 6 wherein the apparatus is mounted on a wheeled cart and fluid communication is provided via flexible tubing connected to the apparatus on the cart for exhausting the warm and humid air from the room, and for drawing the outside ambient air into the room.

* * * * *